US005538604A

United States Patent [19]

Keller et al.

[11] Patent Number: 5,538,604

[45] Date of Patent: Jul. 23, 1996

[54] SUPPRESSION OF CYANIDE FORMATION IN ELECTROLYTIC CELL LINING

[75] Inventors: Rudolf Keller, Export; C. Norman Cochran, Oakmont; David B. Stofesky, Pittsburgh, all of Pa.

[73] Assignee: EMEC Consultants, Export, Pa.

[21] Appl. No.: 375,790

[22] Filed: Jan. 20, 1995

[51] Int. Cl.[6] ..... C25C 3/08

[52] U.S. Cl. ..... 204/243 R; 204/294; 266/280

[58] Field of Search ..... 204/67, 243 R–247, 204/294; 266/280

[56] References Cited

U.S. PATENT DOCUMENTS

| | | | |
|---|---|---|---|
| 3,471,380 | 10/1969 | Bullough | 204/294 X |
| 3,635,408 | 1/1972 | Williams | 204/294 X |
| 4,052,288 | 10/1977 | Sala | 204/243 R |
| 4,396,481 | 8/1983 | Pawlek et al. | 204/243 R |
| 4,576,651 | 3/1986 | Deutschman | 134/25.1 |
| 4,647,357 | 3/1987 | Dewing | 204/243 R |
| 4,763,585 | 8/1988 | Rickman et al. | 110/346 |
| 4,784,733 | 11/1988 | Cutshall et al. | 204/294 X |
| 4,973,464 | 11/1990 | Rickman | 423/461 |
| 4,993,323 | 2/1991 | Tabery et al. | 110/346 |
| 5,024,822 | 6/1991 | Hittner et al. | 423/111 |
| 5,203,971 | 4/1993 | de Nora et al. | 204/294 X |
| 5,222,448 | 6/1993 | Morgenthaler et al. | 110/346 |
| 5,245,116 | 9/1993 | Bontron et al. | 588/248 |
| 5,286,353 | 2/1994 | Wilkening | 204/67 |

FOREIGN PATENT DOCUMENTS 175159 5/1992 Norway .

*Primary Examiner*—Donald R. Valentine
*Attorney, Agent, or Firm*—Andrew Alexander

[57] ABSTRACT

Disclosed is an improved carbonaceous material suitable for use as a liner in an aluminum producing electrolytic cell, the cell using an electrolyte comprised of sodium containing compounds and the carbonaceous material penetrable by sodium or nitrogen and resistant to formation or accumulation of sodium cyanide during operation of the cell. The carbonaceous material is comprised of carbon and a reactive compound capable of reacting with one of sodium, nitrogen and sodium cyanide during operation of the cell to produce aluminum, the reactive compound present in an amount sufficient to suppress formation or accumulation of cyanide compounds in the liner.

28 Claims, 1 Drawing Sheet

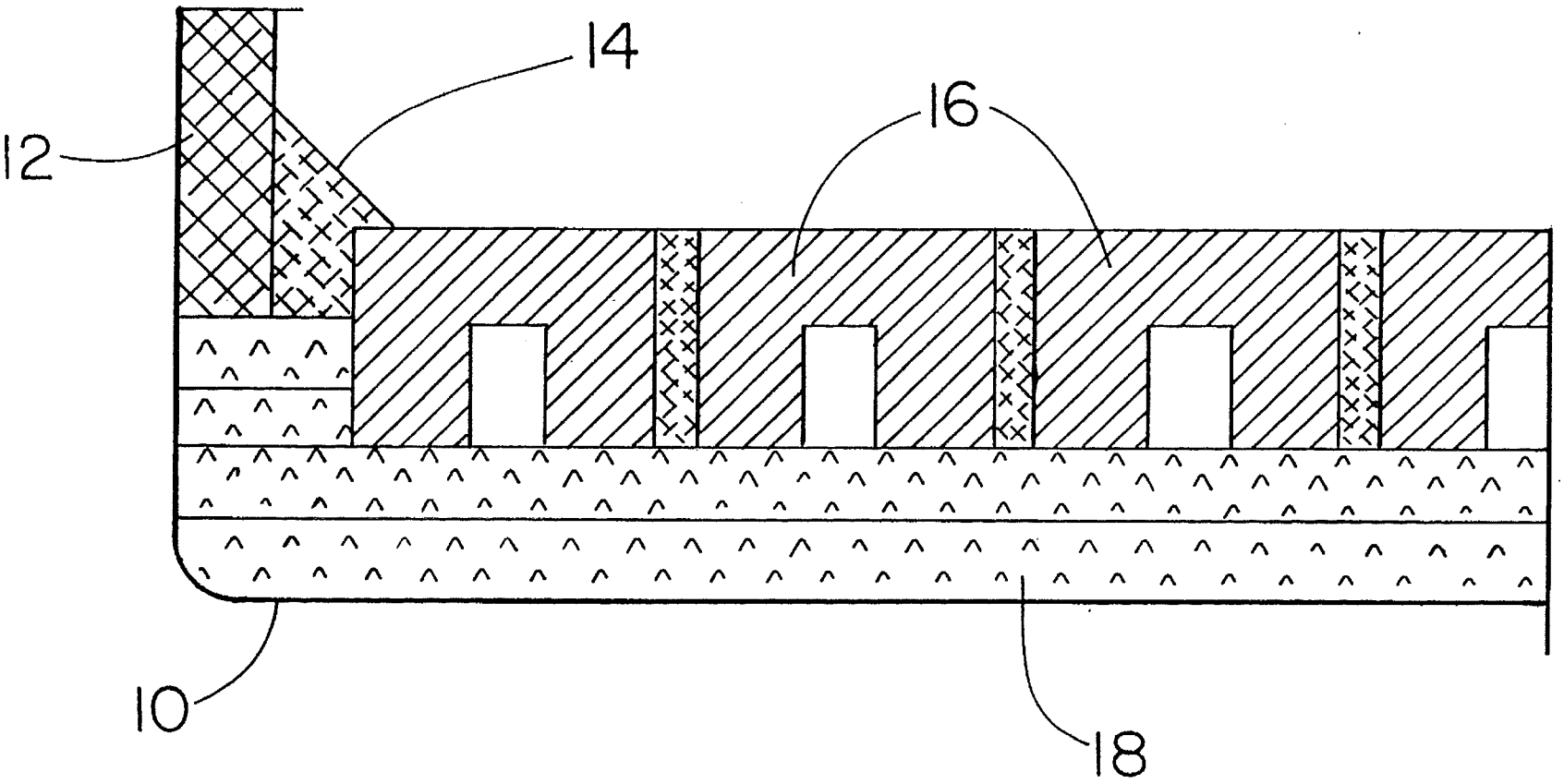
12
14
16
18
10

SUPPRESSION OF CYANIDE FORMATION IN ELECTROLYTIC CELL LINING

BACKGROUND OF THE INVENTION

This invention relates to cyanide formation in the lining of electrolytic cells, and more particularly it relates to the suppression of cyanide formation in carbonaceous materials used in electrolytic cells for producing aluminum such as in the carbonaceous linings of Hall cells.

In the Hall-Heroult process for making primary aluminum, aluminum oxide is dissolved in a molten salt such as cryolite and then electrolyzed to form molten aluminum at the cathode. The electrolysis is carried out at a temperature in the range of about 930° to 980° C. The molten salt is contained in a steel shell which is lined with refractories and carbonaceous material. The lining containing the cathode metal, located in the bottom of the cell, is usually made of carbon materials. In addition, refractories are used to maintain thermal conditions in the cell. The amount of carbon used is substantial. For example, a Hall-Heroult cell of moderate size uses about 24,000 pounds of carbon block for lining purposes and uses about 10,000 pounds of carbon ramming paste to complete the lining and to hold the carbon blocks in place. The cell has to be relined about every 4 to 6 years, producing large quantities of used carbonaceous material and refractories, i.e., spent potlining.

Disposing of the spent potlining is not without problems because the lining contains, among other materials, cyanide, e.g., sodium cyanide, typically on the order of about 0.1 wt. %. The amount of cyanide in the used cell liner can vary depending on how long the cell has been used, on the type of carbon used, cell design and how it is operated. The sodium cyanide forms in the liner material during the operation of the cell as a result of sodium, carbon and nitrogen being present. Because the spent potlining contains cyanides, it has been listed by the Environmental Protection Agency as a hazardous waste. Thus, there is a great need for a process that permits the use of the carbonaceous liner without the formation of cyanide.

In the past, numerous approaches have been used to convert the cyanides and to render the spent potliner material safe for disposal. For example, U.S. Pat. No. 5,222,448 discloses that spent potliner is treated by introducing it into a vessel, and exposing it to the heat of a plasma torch at a temperature of at least 1000° C. As a result, carbon is gasified and convened to combustible carbon monoxide or hydrocarbons, or to carbon dioxide; inorganic material is melted to form slag; fluoride compounds are melted, vaporized, or reduced to gaseous HF; cyanide compounds are destroyed; and all other materials, including sulfur compounds, are either melted or gasified. As a result, the spent potliner is rendered non-hazardous, and the quantity of remaining slag has both its solid volume and mass substantially reduced by a factor of at least 1.5:1 in mass and at least 3:1 in volume relative to the input spent potliner.

U.S. Pat. No. 4,576,651 discloses a process for treating fluoride-contaminated scrap lining material from electrolytic reduction cells which comprises mixing the material with 7–30 parts of sulfuric acid and sufficient water to bring liquid content to 60–80 parts per 100 parts of lining material, mixing in sufficient lime to at least neutralize the sulfuric acid and make the slurry slightly alkaline, the slurry then being allowed to set into a solid mass. The slurry should be of a paste-like consistency. The lime may be wholly calcium hydroxide, but a substantial proportion may be in the form of calcium carbonate. The scrap, before or after the above treatment with lime and sulfuric acid, is preferably heated to 150°–500° C. in the presence of water vapor to destroy cyanides.

U.S. Pat. No. 4,763,585 discloses a process for the combustion of ground, spent potlinings generated during the production of metallic aluminum. The process includes grinding the potlinings to a particle size of not greater than about 2 inches in any dimension; mixing with the ground potlinings from about 1 to about 20 wt. %, based upon the weight of the potlinings, of a powdered inert additive having a median particle size of not greater than 10 micrometers, and burning the ground potlinings in a combustor at a temperature in the range of from 1400° F. to about 2200° F., the additive coating the ground potlinings and preventing their agglomeration in the combustion zone therein.

U.S. Pat. No. 4,973,464 discloses a method for removal of cyanides from spent potlinings from aluminum manufacture. The method discloses the treatment of ground, spent potlinings generated during the production of metallic aluminum to reduce cyanide content to environmentally nonhazardous levels. Potlinings are ground or otherwise suitably reduced in size to a particle size of not greater than about 2 inches in any dimension and roasted in a stream of air or nitrogen at a temperature between about 500° and 1400° F. Roasting for an appropriate time-temperature interval reduces cyanide content to desired levels without combustion of a major portion of carbonaceous material, resulting in an end product rich in carbon and fluorine which may be salable because of this content.

U.S. Pat. No. 4,993,323 discloses that an environmentally acceptable and effective method for thermal destruction of Spent Potliner (SPL) by Fluidized Bed Combustion (FBC) has been established. This method has overcome problems associated with ash agglomeration, ash leachate character and emission control, the primary obstacles for applying FBC to the disposal of SPL and like solid fuels. Specifically, "recipes" of appropriate additives (fuel blends) are proposed. A mixture of lignite, limestone and SPL in an appropriate proportion has proven to notably increase the agglomeration temperature of the ash, allowing this low-melting waste to be destroyed continuously by FBC. Ash leachate character is modified by control of ash chemistry to ensure that fluoride anions and metallic cations are at or below acceptable limits.

U.S. Pat. No. 5,024,822 discloses a process for treating spent potlining from the electrolytic smelting of aluminum in cryolite including incinerating the potlining to combust carbonaceous material to forth an ash at a temperature low enough to maintain low fluorine vapor pressures, admixing siliceous material with the potlining either before or after the ash-forming stage, and heating the ash and siliceous material to form a glassy residue.

In Norwegian Disclosure 175,159, the cyanide-containing potlining is treated in situ by raising the cell temperature before shut-down of the cell, thus promoting penetration of electrolyte into the lining to react with the cyanide.

However, it will be noted that these treatments are post-treatments to correct the hazardous waste problems resulting from spent potlinings, and most of them are relatively expensive. Thus, it will be seen that there is a great need for a method that permits the use of carbonaceous liners but is effective in preventing formation of undesirable compounds such as cyanide compounds during use of the cell to produce aluminum. By preventing formation of compounds such as cyanide compounds, any post-treatment can be greatly simplified.

SUMMARY OF THE INVENTION

It is an object of the invention to provide an improved carbonaceous potlining for aluminum producing electrolytic cell.

It is another object of the invention to provide an improved carbonaceous potlining for an aluminum producing electrolytic cell capable of suppressing formation of cyanide compounds during operation of the cell.

Yet, it is another object of the present invention to provide a novel carbonaceous composition suitable for use as a potliner in aluminum-producing electrolytic cells for suppressing formation of cyanides during operation of the cell.

These and other objects will become apparent from reading the specification and claims appended hereto.

In accordance with these objects, there is provided an improved carbonaceous material suitable for use as a liner in an aluminum producing electrolytic cell, the cell using an electrolyte comprised of sodium containing compounds and the carbonaceous material penetrable by sodium or nitrogen and resistant to formation or accumulation of sodium cyanide during operation of the cell. The carbonaceous material is comprised of carbon and a reactive compound capable of reacting with one or more of sodium, nitrogen and sodium cyanide during operation of the cell to produce aluminum, the reactive compound present in an amount sufficient to suppress formation or accumulation of cyanide compounds in the liner.

BRIEF DESCRIPTION OF THE DRAWING

The FIGURE is a cross-sectional view of a section of a wall and bottom of a Hall cell used for making aluminum.

DETAILED DESCRIPTION OF PREFERRED EMBODIMENTS

As noted, cyanide compounds form in the carbonaceous lining of electrolytic cells during the production of aluminum. Cyanide compounds form in the carbonaceous material from the presence of carbon, sodium and nitrogen at elevated temperatures. The carbon source is the carbonaceous cell lining, i.e., carbonaceous blocks, carbonaceous boards, and carbonaceous based ramming mix and seam paste used. Sodium results from the molten salt electrolyte containing cryolite ($Na_3AlF_6$) used to dissolve alumina ($Al_2O_3$). In the electrolytic reduction of alumina to aluminum and carbon dioxide, sodium of the electrolyte is reduced at the same time as the alumina. The sodium that is reduced from electrolyte provides free sodium. The sodium migrates or is transferred through or into the carbonaceous lining and ramming paste. The source of nitrogen for the reaction is provided by the air which penetrates into the cathode blocks and into the carbonaceous liner. The reaction that produces undesirable sodium cyanide is as follows:

$$2C+2Na+N_2 \rightarrow 2NaCN$$

Thus, the purpose of the present invention is to suppress or stop the formation or accumulation of cyanide compounds such as sodium cyanide in potlinings of aluminum-producing electrolytic cells. Accordingly, there is provided a novel carbonaceous base material and a reactive compound suitable for potlinings, cathode blocks, ramming paste and seam mix which is resistant to formation of cyanide compounds. The reactive compound must be capable of reacting with sodium, nitrogen or sodium cyanide under the conditions prevailing in the carbonaceous material present in the liner, cathode block, or ramming mix utilized in an aluminum-producing electrolyte cell. Thus, the novel material can comprise 0.1 to 30 wt. % of a compound reactive with sodium, nitrogen or sodium cyanide in the presence of carbon to avoid or suppress the formation or accumulation of cyanide compounds, the remainder of the novel material comprising carbon. By carbon as used herein is meant to include carbon as used in potlinings, cathode blocks, ramming paste, and seam mix as used in aluminum-producing electrolytic cells.

The novel carbonaceous base material can comprise carbon and 0.1 to 30 wt. % of a reactive compound of a carbide, fluoride, carbonate, or oxide, the compound reactive with sodium, nitrogen or sodium cyanide in the presence of carbon to avoid the formation or accumulation of cyanide compounds. A metal reactive with sodium, nitrogen or sodium cyanide such as aluminum, magnesium, silicon, boron or zinc, may be used. The metals may be provided in finely divided or powder form. Examples of reactive carbide compounds useful in said novel material include silicon carbide, aluminum carbide, titanium carbide and boron carbide. Reactive fluoride compounds useful in the novel invention include aluminum fluoride ($AlF_3$), cryolite ($Na_3AlF_6$), titanium fluoride ($TiF_3$), zirconium fluoride ($ZrF_4$), calcium fluoride ($CaF_2$) and magnesium fluoride ($MgF_2$). Examples of reactive carbonate compounds useful in said novel invention are lithium carbonate ($Li_2CO_3$), calcium carbonate ($CaCO_3$) and barium carbonate ($BaCO_3$). Examples of reactive oxide compounds include boron oxide, sodium borate, calcium borate, sodium tetraborate, boric acid, calcium oxide and rare earth oxides.

Of the above compounds reactive with sodium, nitrogen or sodium cyanide, the preferred reactive compounds are boron oxide and its derivatives such as boric acid, sodium borate and sodium tetraborate. That is, the boron oxide compounds are preferred because they can combine with sodium or nitrogen. Further, the boron oxide compounds are preferred because they are reactive with cyanide compounds such as sodium cyanide to convert or decompose it to environmentally benign compounds such as boron nitride and sodium borates. That is, if for some reason, sodium cyanide forms, reactive boron oxide compounds are effective in reacting and convening the cyanide compound to environmentally benign compounds. Of the boron oxide compounds, boron oxide ($B_2O_3$) is preferred. Also, preferably, the novel material comprises carbon and 0.5 to 5 wt. % reactive compound. A typical amount of reactive compound is in the range of 1 to 2 wt. %. It will be appreciated that combinations of such compounds may be used.

The reactive compound should be capable of reacting with sodium, nitrogen or sodium cyanide at operating conditions prevalent in the carbonaceous material in the electrolyte cell during operation. Thus, the reactive compound should be capable of reacting with sodium, nitrogen or sodium cyanide in the presence of carbon in a temperature range of 500° to 1000° C. Further, a reactive compound that is reactive with sodium can also lessen the harmful effect of sodium intercalation into the potlining, thus leading to extended pot life.

The FIGURE shows a typical construction of a cell bottom 10 with prebaked lining 12 and rammed joints 14. Prefabricated cathode blocks 16 are placed on top of insulating refractories 18. Blocks 16 are traditionally made from rotary kiln or gas calcined anthracite aggregate or electrically calcined anthracite, mixed with a pitch binder. Graphite components can be substituted to increase electrical conductivity. In prefabrication of cathode blocks, green blocks are shaped and pressed, and subsequently baked in special furnaces. Ramming paste 14 is used to fill the spaces and form seams between individual cathode blocks, also to connect the side walls with the carbon blocks. Hot ramming pastes consist of an anthracitic filler and a pitch binder. Room temperature paste binder formulations are usually based on a coal-tar or a coal-tar pitch, with a solvent or other additive to lower its softening point and/or increase its coke yield. Also, molasses or additions of solid pitch fines may be included in some formulations. The ramming paste is baked in situ on cell start-up. Ramming paste may be used for the carbonaceous cathodes to form the so-called monolithic cathodes. The sidewalls are usually made from prebaked carbon blocks, ramming paste, or a combination of both. The desired properties of the sidewall are, however, different from those sought for the cathode bottom, and carbon sidewalls are not always the preferred choice.

In the process of using the present invention, a carbonaceous material comprising carbon and the reactive compound are mixed thoroughly and then fabricated into a suitable inner cathode block, ramming mix, or seam mix for use in an aluminum-producing electrolytic cell. That is, the reactive compound s mixed with carbon and/or pitch, depending on the end use, to form a green mix. The green mix is then shaped into cathode blocks or liner. The green cathode blocks are then baked before use, whereby volatile material is driven off. Ramming paste is baked in situ on cell start-up. Then, during operation of the cell, the reactive compound mixed into the carbonaceous mix will operate to scavenge sodium or nitrogen by forming compounds which prevent the formation of cyanide. Sodium cyanide, as it is generated and penetrates the walls or cathode of the cell, will be decomposed by the reactive compound even at places separated from its formation.

In the invention, the amount of the reactive compound dispersed in the carbon material can be varied depending on the potlining and its location in the cell. For example, pockets or layers of the reactive compound can be positioned strategically, if desired. Further, in electrolytic cells that have been in operation, bore holes can be drilled in the potliner or cathode and such holes filled with the reactive compound. When the reactive compound is boron oxide, for example, it has the capability of reacting with the sodium cyanide to form boron nitride and sodium borates according to the following reaction:

$$6NaCN+7B_2O_3 \rightarrow 6C+2N_2+2BN+3Na_2B_4O_7.$$

Thus, it will be appreciated that the electrolytic cell can be operated for a number of years and then treated as noted to decompose sodium cyanide formed in the liner, ramming mix or cathode block to capture free sodium or nitrogen therein.

The following examples illustrate the effectiveness of different reactive compounds in suppressing formation of sodium cyanide carbon potlining material used in electrolytic cells for the production of aluminum.

EXAMPLE 1

To carbonaceous material used as a commercial ramming mix (Midwest Carbon), composed of sized gas-calcined anthracite coal and about 10% coal-tar pitch, was added aluminum carbide, $Al_4C_3$, to provide a mix containing 3 wt. % $Al_4C_3$. A 47.5 gm sample of the mix containing $Al_4C_3$ was exposed to 2.60 gm of sodium and a nitrogen atmosphere at 600° C. After 3 hours of heating, 646 ml of nitrogen was consumed. The sample was then analyzed and found to contain 1.49 wt. % cyanide (CN). Another sample was treated in the same way except $Al_4C_3$ was not added. The sample without $Al_4C_3$ was found to contain about 2.6 wt. % cyanide (CN). Thus, the addition of $Al_4C_3$ resulted in a decrease of 40% in the amount of cyanide formed.

EXAMPLE 2

Several reactive compounds were tested to determine their effectiveness in suppressing sodium cyanide formation in potlining material. The samples were prepared and tested as in Example 1. The reactive compounds and results are provided in Table 1.

TABLE 1

| Sodium Weight (g) | Reactive Compound (Initial wt. %) | ΔVN2 (ml) | Weight CN (g) | % CN Reduction |
|---|---|---|---|---|
| 2.60 | none | −747 | 1.365 | — |
| 2.60 | 5 wt. % $SiO_2$ | −418 | 0.633 | 53.6 |
| 2.60 | 5 wt. % $Al_4C_3$ | −631 | 0.975 | 28.6 |
| 2.60 | 3 wt. % $B_4C$ | −392 | 0.407 | 70.2 |
| 1.15 | none | −297 | 0.574 | — |
| 1.15 | 8.2 wt. % SiC | −265 | 0.444 | 22.6 |
| 1.15 | 5 wt. % $B_2O_3$ | −15 | 0.013 | 97.7 |
| 1.15 | 20 wt. % $B_2O_3$ | +46 | 0.0004 | 99.9 |

It will be seen from Table 1 that $B_2O_3$ was the most effective reactive compound in suppressing formation of cyanide. That is, the 20 wt. % $B_2O_3$ sample only contained about 9 ppm cyanide in a 45.8 gm sample. It should be noted that these conditions for the test are believed to be more severe than normal aluminum electrolytic cell production conditions, and the test conditions are believed to favor cyanide formation more than cell production conditions would. In the test, sodium was present at unit activity, and its activity in a potlining is about 0.05. Further, in the test, excess quantities of nitrogen were provided and the temperature of the test, 600° C., is believed to be more favorable to cyanide formation than the higher temperatures at which aluminum production cells are operated.

While the invention has been described in terms of preferred embodiments, the claims appended hereto are intended to encompass other embodiments which fall within the spirit of the invention.

What is claimed is:

1. An improved carbonaceous material suitable for use as liner material in an aluminum producing electrolytic cell, said cell using an electrolyte comprised of sodium containing compounds and said carbonaceous material penetrable by sodium or nitrogen and resistant to formation or accumulation of sodium cyanide during operation of said cell, the carbonaceous material comprised of:

(a) carbon; and (b) a reactive compound capable of reacting with sodium cyanide during operation of said cell to produce aluminum, said reactive compound present in an amount sufficient to suppress formation or accumulation of cyanide compounds in said liner.

2. The carbonaceous material in accordance with claim 1 wherein said reactive compound is present in the range of 0.1 to 30 wt. %.

3. The carbonaceous material in accordance with claim 1 wherein said reactive compound is selected from the group consisting of carbide, fluoride and oxide compounds.

4. The carbonaceous material in accordance with claim 1 wherein said reactive compound is a carbide compound selected from the group consisting of silicon carbide, aluminum carbide, titanium carbide and boron carbide.

5. The carbonaceous material in accordance with claim 1 wherein said reactive compound is a fluoride compound selected from the group consisting of cryolite, aluminum fluoride, titanium fluoride, zirconium fluoride, calcium fluoride and magnesium fluoride.

6. The carbonaceous material in accordance with claim 1 wherein said reactive compound is an oxide compound selected from the group consisting of boron oxide, sodium borate, aluminum borate, sodium tetraborate, calcium borate, boric acid, calcium oxide and rare earth oxides.

7. The carbonaceous material in accordance with claim 1 wherein said reactive compound is boron oxide.

8. An improved carbonaceous ramming mix suitable for a monolithic lining and for sealing liner components in an aluminum producing electrolytic cell, said cell using an electrolyte comprised of sodium containing compounds and said carbonaceous material penetrable by sodium or nitrogen and resistant to formation or accumulation of sodium cyanide during operation of said cell, the carbonaceous material comprised of:

(a) carbon; and (b) a reactive compound capable of reacting with sodium cyanide during operation of said cell to produce aluminum, said reactive compound present in an amount sufficient to suppress formation or accumulation of cyanide compounds in said liner.

9. An improved carbonaceous cathode for use in an aluminum producing electrolytic cell, said cell using an electrolyte comprised of sodium containing compounds and said carbonaceous cathode penetrable by sodium or nitrogen and resistant to formation or accumulation of sodium cyanide during operation of said cell, the carbonaceous cathode comprised of:

(a) carbon; and (b) a reactive compound capable of reacting with sodium cyanide during operation of said cell to produce aluminum, said reactive compound present in an mount sufficient to suppress formation or accumulation of cyanide compounds in said carbonaceous cathode.

10. The carbonaceous material in accordance with claim 9 wherein said reactive compound is present in the range of 0.1 to 30 wt. %.

11. An improved carbonaceous material for a liner including cathode and ramming mix in an aluminum-producing electrolytic cell, the cell using a sodium-containing electrolyte, the carbonaceous material resistant to formation or accumulation of sodium cyanide during operation of the cell, the carbonaceous material comprised of:

(a) carbon; and (b) boron oxide for reacting with one of the group consisting of sodium, nitrogen and sodium cyanide during operation of said cell to suppress formation or accumulation of cyanide compounds in said carbonaceous material during operation of said cell.

12. The carbonaceous material in accordance with claim 11 wherein said reactive compound is present in the range of 0.1 to 30 wt. %.

13. In an electrolytic cell for producing aluminum from alumina dissolved in a sodium containing electrolyte wherein during operation of said cell, aluminum is deposited at a cathode, the cell having a liner and at least one of cathodes block and ramming mix fabricated from a carbonaceous material, the improvement wherein said carbonaceous material has associated therewith a reactive compound capable of reacting with sodium cyanide during operation of said cell to produce aluminum, said reactive compound present in an amount sufficient to suppress formation or accumulation of cyanide compounds in said carbonaceous material.

14. The carbonaceous material in accordance with claim 13 wherein said reactive compound is present in the range of 0.1 to 30 wt. %.

15. The carbonaceous material in accordance with claim 13 wherein said reactive compound is selected from the group consisting of carbide, fluoride and oxide compounds.

16. The carbonaceous material in accordance with claim 13 wherein said reactive compound is a carbide compound selected from the group consisting of silicon carbide, aluminum carbide, titanium carbide and boron carbide.

17. The carbonaceous material in accordance with claim 13 wherein said reactive compound is a fluoride compound selected from the group consisting of cryolite, aluminum fluoride, titanium fluoride, zirconium fluoride, calcium fluoride and magnesium fluoride.

18. The carbonaceous material in accordance with claim 13 wherein said reactive compound is an oxide compound selected from the group consisting of boron oxide, sodium borate, sodium tetraborate, calcium borate, boric acid, calcium oxide and rare earth oxides.

19. The carbonaceous material in accordance with claim 13 wherein said reactive compound is boron oxide.

20. In an electrolytic cell for producing aluminum from alumina dissolved in a sodium containing electrolyte wherein during operation of said cell, aluminum is deposited at a cathode, the cell having a refractory liner and a carbon source, the improvement wherein said refractory liner has associated therewith a reactive compound capable of reacting with sodium cyanide during operation of said cell to produce aluminum, said reactive compound present in an amount sufficient to suppress formation or accumulation of cyanide compounds in said refractory liner.

21. The refractory liner in accordance with claim 20 wherein said reactive compound is present in the range of 0.1 to 30 wt. %.

22. The refractory liner in accordance with claim 20 wherein said reactive compound is an oxide compound selected from the group consisting of boron oxide, sodium borate, sodium tetraborate, calcium borate, boric acid and calcium oxide.

23. The refractory liner in accordance with claim 20 wherein said reactive compound is boron oxide.

24. An improved carbonaceous material suitable for use as liner material in an aluminum producing electrolytic cell, said cell using an electrolyte comprised of sodium containing compounds and said carbonaceous material penetrable by sodium or nitrogen and resistant to formation or accumulation of sodium cyanide during operation of said cell, the carbonaceous material comprised of:

(a) carbon; and (b) a reactive compound capable of reacting with one of sodium, nitrogen and sodium cyanide during operation of said cell, said reactive compound selected from the group consisting of boron oxide, sodium borate, sodium tetraborate, calcium borate, boric acid, calcium oxide and rare earth oxides, said reactive compound present in an amount sufficient to suppress formation or accumulation of cyanide compounds in said liner.

25. An improved carbonaceous ramming mix suitable for a monolithic lining and for sealing liner components in an aluminum producing electrolytic cell, said cell using an electrolyte comprised of sodium containing compounds and said carbonaceous material penetrable by sodium or nitrogen and resistant to formation or accumulation of sodium cyanide during operation of said cell, the carbonaceous material comprised of:

(a) carbon; and (b) a reactive compound capable of reacting with one of sodium, nitrogen and sodium cyanide during operation of said cell, said reactive compound selected from the group consisting of boron oxide, sodium borate, sodium tetraborate, calcium borate, boric acid, calcium oxide and rare earth oxides, said reactive compound present in an amount sufficient to suppress formation or accumulation of cyanide compounds in said liner.

26. An improved carbonaceous cathode for use in an aluminum producing electrolytic cell, said cell using an electrolyte comprised of sodium containing compounds and said carbonaceous cathode penetrable by sodium or nitrogen and resistant to formation or accumulation of sodium cyanide during operation of said cell, the carbonaceous cathode comprised of:

(a) carbon; and (b) a reactive compound capable of reacting with one of sodium, nitrogen and sodium cyanide during operation of said cell, said reactive compound selected from the group consisting of boron oxide, sodium borate, sodium tetraborate, calcium borate, boric acid, calcium oxide and rare earth oxides, said reactive compound present in an amount sufficient to suppress formation or accumulation of cyanide compounds in said carbonaceous cathode.

27. In an electrolytic cell for producing aluminum from alumina dissolved in a sodium containing electrolyte wherein during operation of said cell, aluminum is deposited at a cathode, the cell having a liner and at least one of cathode blocks and ramming mix fabricated from a carbonaceous material, the improvement wherein said carbonaceous material has associated therewith a reactive compound capable of reacting with one of sodium, nitrogen and sodium cyanide during operation of said cell, said reactive compound selected from the group consisting of boron oxide, sodium borate, sodium tetraborate, calcium borate, boric acid, calcium oxide and rare earth oxides, said reactive compound present in an amount sufficient to suppress formation or accumulation of cyanide compounds in said carbonaceous material.

28. In an electrolytic cell for producing aluminum from alumina dissolved in a sodium containing electrolyte wherein during operation of said cell, aluminum is deposited at a cathode, the cell having a refractory liner and a carbon source, the improvement wherein said refractory liner has associated therewith a reactive compound capable of reacting with one of sodium, nitrogen and sodium cyanide during operation of said cell, said reactive compound selected from the group consisting of boron oxide, sodium borate, sodium tetraborate, calcium borate, boric acid, calcium oxide and rare earth oxides, said reactive compound present in an amount sufficient to suppress formation or accumulation of cyanide compounds in said refractory liner.

* * * * *